US006843155B2

(12) United States Patent
Slyne

(10) Patent No.: US 6,843,155 B2
(45) Date of Patent: Jan. 18, 2005

(54) PATTERN CUTTING

(76) Inventor: William J. Slyne, 28 Misty Moor Drive, Richmond Hill (CA), L4C 6R1

( * ) Notice: Subject to any disclaimer, the term of this patent is extended or adjusted under 35 U.S.C. 154(b) by 0 days.

(21) Appl. No.: 09/094,719

(22) Filed: Jun. 15, 1998

(65) Prior Publication Data

US 2002/0011138 A1 Jan. 31, 2002

(51) Int. Cl.[7] ..... B26D 1/00

(52) U.S. Cl. ..... 83/13; 83/56; 83/360; 83/747; 83/940; 700/134

(58) Field of Search ..... 700/134, 135; 83/22, 37, 39, 48, 55, 76.1, 303, 343, 346, 347, 353, 357, 451, 485, 487, 505, 591, 936, 937, 938, 40, 44, 46, 47, 56, 614, 649

(56) References Cited

U.S. PATENT DOCUMENTS

| | | | | | |
|---|---|---|---|---|---|
| 3,527,127 | A | * | 9/1970 | Stovall | 83/23 |
| 3,614,369 | A | | 10/1971 | Medley | |
| 3,774,485 | A | * | 11/1973 | Kercher | 83/13 |
| 3,783,723 | A | * | 1/1974 | Van Orden | 83/21 |
| 3,878,771 | A | * | 4/1975 | Malcolm | 93/36.01 |
| 4,133,233 | A | * | 1/1979 | Pearl | 83/56 |
| 4,163,180 | A | * | 7/1979 | Dowd | 318/6 |
| 4,172,564 | A | * | 10/1979 | Romagnoli | 242/58.3 |
| 4,226,112 | A | | 10/1980 | Jibelian | |
| 4,305,716 | A | * | 12/1981 | Nickum | 493/342 |
| 4,391,168 | A | | 7/1983 | Gerber et al. | |
| 4,466,316 | A | * | 8/1984 | Kobayashi et al. | 83/13 |
| 4,480,516 | A | * | 11/1984 | Leroy | 83/98 |
| 4,512,226 | A | * | 4/1985 | Juckett | 83/56 |
| 4,570,518 | A | * | 2/1986 | Burmeister et al. | 83/504 |
| 4,725,961 | A | * | 2/1988 | Pearl | 364/475 |
| 4,785,696 | A | * | 11/1988 | Martiny | 83/152 |
| 4,856,442 | A | * | 8/1989 | Brocklehurst | 112/147 |
| 4,932,932 | A | * | 6/1990 | Schmidt et al. | 493/200 |
| 5,009,740 | A | * | 4/1991 | Yanai | 156/353 |
| 5,036,359 | A | * | 7/1991 | Duijve et al. | 355/203 |
| 5,086,607 | A | * | 2/1992 | Ozeki | 53/389 |
| 5,105,702 | A | * | 4/1992 | Fara | 83/425 |
| 5,367,934 | A | * | 11/1994 | MacNiel | 83/425.2 |
| 5,373,761 | A | * | 12/1994 | Brining | 83/31 |
| 5,379,497 | A | * | 1/1995 | Nielsen et al. | 26/15 R |
| 5,379,498 | A | * | 1/1995 | Nielsen et al. | 26/15 N |
| 5,484,499 | A | * | 1/1996 | Marschke | 156/193 |
| 5,553,522 | A | * | 9/1996 | Boldrini et al. | 83/13 |
| 5,816,124 | A | * | 10/1998 | Madrzak | 83/13 |
| 5,944,273 | A | * | 8/1999 | Lin et al. | 242/160.4 |
| 6,022,442 | A | * | 2/2000 | Seidl | 156/256 |
| 6,062,285 | A | * | 5/2000 | Dotta et al. | 156/512 |
| 6,106,649 | A | * | 8/2000 | Slyne | 156/179 |
| 6,152,003 | A | * | 11/2000 | Jung | 83/74 |
| 2002/0011138 | A1 | * | 1/2002 | Slyne | 83/13 |

OTHER PUBLICATIONS

"Pool Maker Adopts Technology from Seafaring Source" from Aqua, Sep. 1992 Eastman® EC3 distributed by Eastman 1997.

* cited by examiner

*Primary Examiner*—Minh Trinh
(74) *Attorney, Agent, or Firm*—John H. Thomas, P.C.

(57) ABSTRACT

A method of cutting pattern pieces from a continuous roll of material comprising the steps of unrolling said material unto a rotating cylindrical cutting surface, and then cutting said material while said material is in rolling contact on said cylindrical surface during rotation of said cylindrical surface. Furthermore this invention describes a method and apparatus for producing vinyl pool covers.

2 Claims, 10 Drawing Sheets

PATTERN CUTTING

FIELD OF INVENTION

This invention relates to apparatus for cutting pattern pieces from a continuous roll of material and particularly relates to the manufacture of vinyl pool liners by utilizing a rotating cylindrical cutting surface.

BACKGROUND ART

A variety of apparatus and methods have heretofore been used in order to cut various patterns from a material which is later to be assembled. For example, the various panels of a jacket maybe designed and drawn on a web of cloth which are then cut out and stitched together to produce the jacket. Another example relates to designing and drawing the various panels on a flexible sheet of material such as vinyl which are cut out and glued or fused together so as to produce a vinyl pool cover.

A variety of cutting apparatus has heretofore been utilized in order to speed up the process and accuracy. One type of cutting apparatus often used is called a wheel cutter or pizza wheel. The wheel cutter generally includes a cutting tool in the form of a cutting wheel having a peripheral cutting edge which rolls on the support surface and moves along a cutting path in cutting engagement with the material. The cutting head can steer the cutting wheel under computer control by rotating the wheel holder about an axis perpendicular to the cutting surface. The cutting wheel and holder may also be castored about the perpendicular axis to allow the natural side forces on the cutting wheel to steer the wheel.

Prior art cutting apparatus have utilized static table cutters. These static table cutters have been commonly used for cutting long pattern pieces or long groups of pattern pieces from rolled goods by means of a cutter head fixed to computer controlled X and Y axis carriages that are driven along the length of long cutting table surface where the carriage is supported on either or both longitudinal edges of the cutting table surface by guide rails affixed to such edges. Computer controlled motors drive X and Y axis carriages to produce the desired motions for cutting selective curves or lines on the cutting surface. The material to be cut is unrolled such that it lays flat on the cutting table surface and is secured by suitable means along the surface. An example of such static table cutter can be found in an article entitled "Pool Maker Adopts Technology From Seafaring Source" published in the September 1992 edition of Aqua which disclosed in part:

(a) computer design of vinyl pool panels;

(b) computer controlled cutting of the vinyl panels;

(c) a cutting machine that rolls back and forth along the table.

Some disadvantage of utilizing static table cutters include:

(a) pattern piece or pattern group length is limited to the length of the cutting table;

(b) the floor space consumption (footprint) is proportional to the longest expected pattern piece or group (c) considerable operator intervention is required to lay down the material properly prior to cutting and removing the cut pieces and scrap after cutting;

(d) the material must be secured over a large area; and if vacuum retention is used, this becomes relatively expensive;

(e) much of the complexity for motor and cutter control must be carried either on the carriage or cable to the carriage along cable tracks.

In either case such arrangement adds mass to the overall design. The total cutting time is the time it takes the cutting head to cut the pieces plus the time required to lay down the material and pick up the cut pieces.

Another arrangement used in the prior art includes conveyorized cutters. Conveyorized cutting apparatus generally include one or more cutting heads each which is suspended above the material affixed to one or more X and Y carriages generally in the same manner as static tables cutters. However, in the conveyorized cutting systems the cutting surface is the upper surface of a closed loop link conveyor. The length of the conveyor can generally be two to three times the width of the cutting surface. Material is pulled from a stationary roll unto the cutting area and the material may be retained to the bed by a vacuum that acts through the top of the bed. The pattern pieces may be cut and the conveyor then advances again to remove the cut pieces and scrap and at the same time pulling material unto the cutting area. Normally the conveyor bed is stationary during cutting but cutting heads may be used to operate while the conveyor bed is moving. In this case the motion of both must be co-ordinated by the computer to provide the desired cut paths.

Conveyorized cutting apparatus also include a variety of draw backs which include:

(a) greater complexity;

(b) the sustained speed of processing of the cut pieces is limited to the maximum speed of the conveyor, normally less than 12" per second;

(c) more complicated vacuum support system;

(d) cutting surface is generally limited to or compliant to present an endless loop and therefore not rigid. The conveyor bed must be flexible in order to lay flat in the cut zone and also be able to complete a circuit or loop such that the conveyor forms a closed loop. This adds mass and cost to the conveyor, while reducing stability.

An example of such computerized cutting apparatus may be found in a flyer distributed by Eastman entitled "Eastman EC3" distributed in 1997.

Moreover, other cutting systems can be found in U.S. Pat. No. 3,614,369 which discloses cloth continuously moved under tension through a cutting zone, and cut by means having applied to it a component of motion oblique to the direction of movement of cloth. Movement of the cutter may be controlled by program means such as magnetic tapes which feed information by a computer and feedback means for controlling the position of the cutter.

It is an object of this invention to provide an improved method and apparatus for cutting pattern pieces from continuous rolled goods.

DISCLOSURE OF INVENTION

It is an aspect of this invention to provide a method of cutting pattern pieces from a continuous roll of material comprising steps of unrolling said material unto a rotating cylindrical cutting surface, and then cutting said material during rotation of said cylindrical surface.

It is a further aspect of this invention to provide an apparatus for cutting pattern pieces from a continuous roll of material comprising: a rotating cylindrical cutting surface for unwinding said material from a roll unto said rotating cylindrical surface; cutting means for cutting said material on said rotating cylindrical cutting surface; rotatable drive means for rotatably driving said cylindrical cutting surface.

BEST MODE FOR CARRYING OUT THE INVENTION

Figure 1:
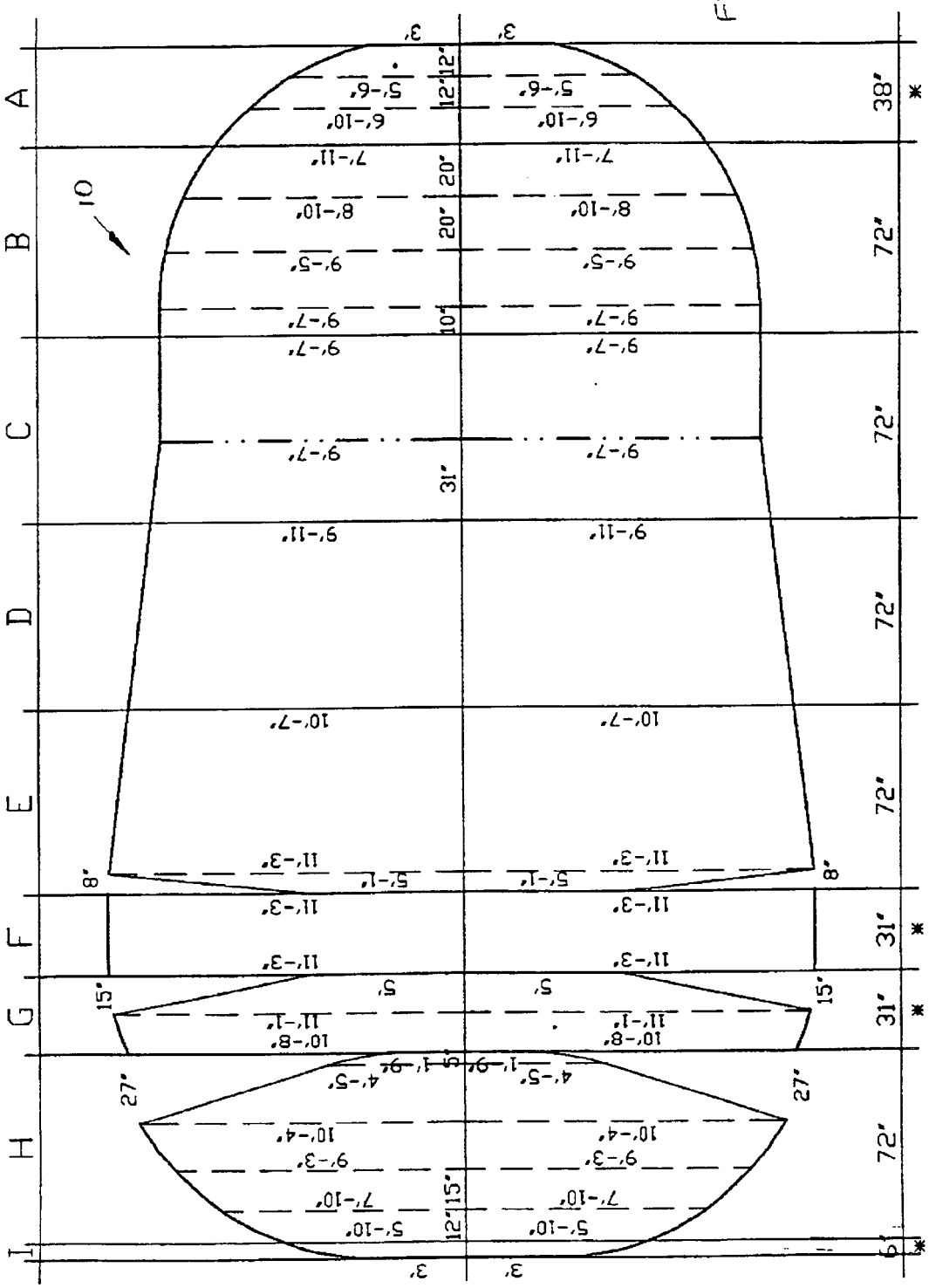
FIG. 1 is an example of a design of a vinyl pool liner.

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 is a sketch showing one example of a pattern of a pool liner 10. Such pattern can be designed by utilizing computer aided design software (CAD). FIG. 1 shows also the dimensions along the various portions of the pool liner 10.

In particular, the pool liner 10 has been divided into nine (9) segments which are lettered A–I. In other words, the pool liner is cut into the nine (9) segments and arranged so as to cut along a continuous web of material 12 as shown from FIG. 2. The continuous web of material 12 is unrolled from a roll of material 14 to be described hereinafter.

The arrangements of the various panels A–I are arranged on the web of material 12 so as to optimize the material utilization as well as the efficiency of the cutting action to be described herein.

For example, the pool liner 10 as shown in FIG. 1 will be assembled from the various segments A–I as shown in FIG. 1. The pattern of the pool liner shown in FIG. 1 shows the shallow section of the pool made up mainly by panels A, B and part of C and the deep end of the pool which is comprised generally of panels E, F, G, H, and I. It is for this reasons that there are triangular slits shown between H and G as well as G and F, and F and E.

Figure 2:
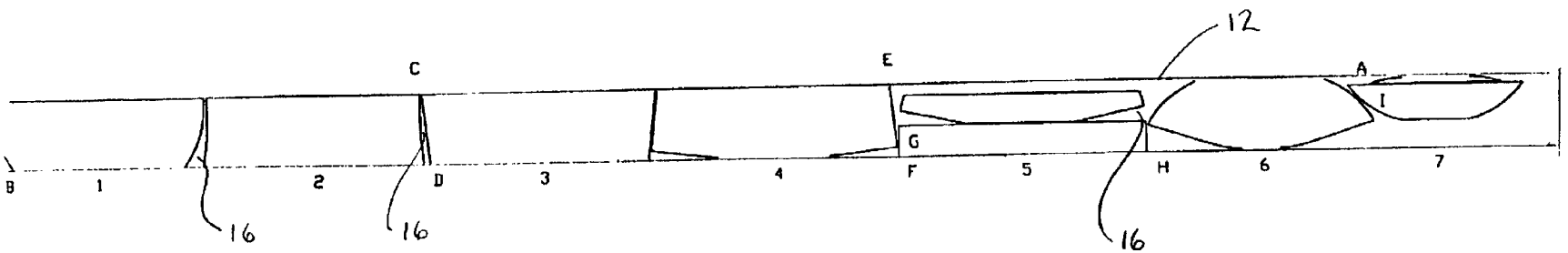
FIG. 2 is a representative drawing of an example of a pattern to be cut from a web of material.

The various panels A–I are arranged on the web of material 12 as shown for example in FIG. 2. Accordingly, panel A is arranged on the web of material 12 to lie below the panel I. Thereafter H is arranged as shown in FIG. 2. The web of material 12 will be cut along the various lines shown in FIG. 2 and very little scrap material 16 will be left. Once the panels A–I are cut they may be then reassembled to exhibit the pattern shown in FIG. 1 and glued to one another so as to produce a seamless pool cover which will be inserted into the ground. Such gluing or securing may be accomplished by a number of means including subjecting the overlaps of the various panels with RF signal which heats the material and fuses same in a manner well known to those skilled in the art. Generally speaking the seams are overlapped by ¾ of an inch so as to produce a strong seam.

Figure 3:
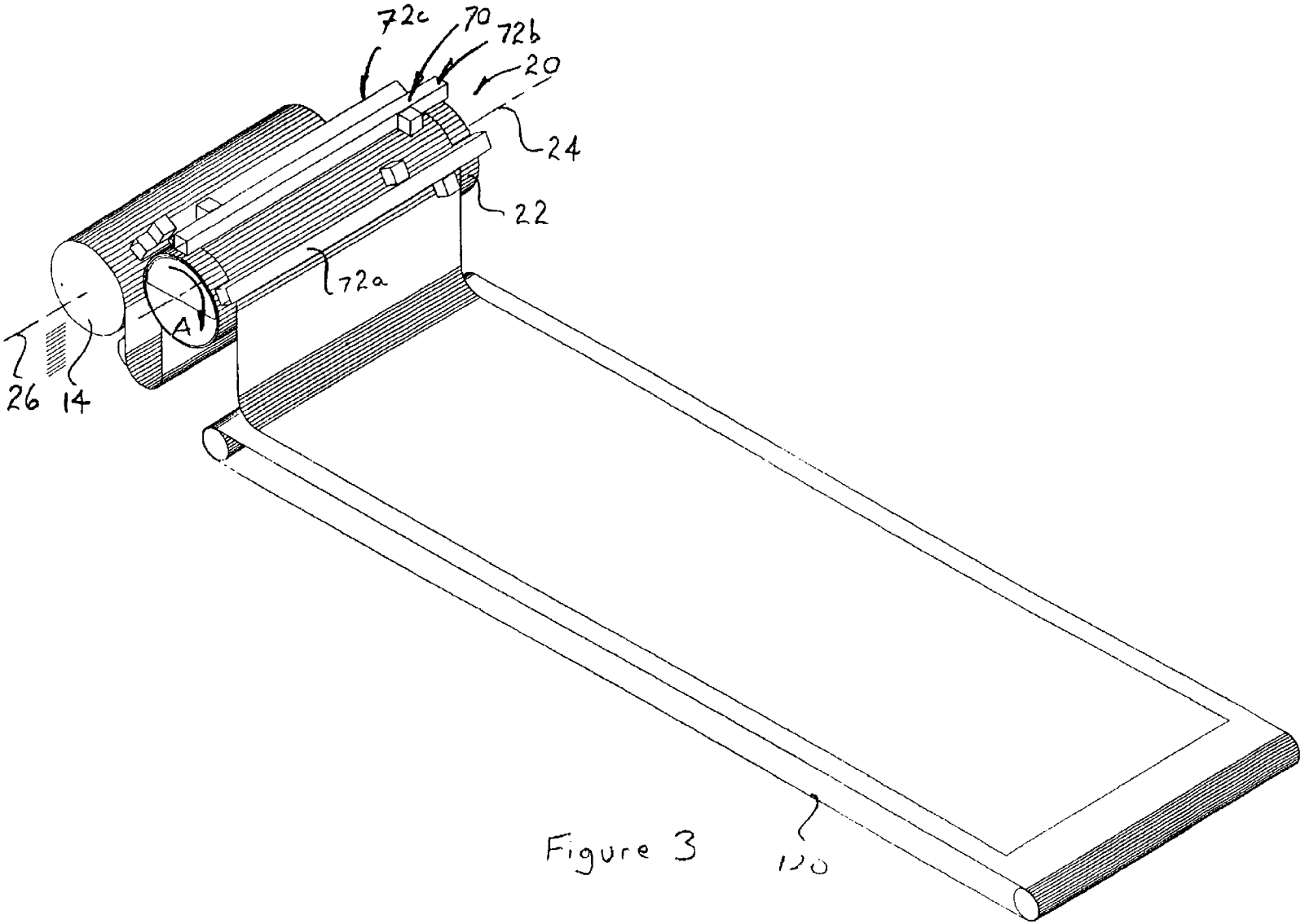
FIG. 3 is a partial perspective view of the rotating drum taken from a point above and to the right of the rotating cylindrical cutting surface.
Figure 4:
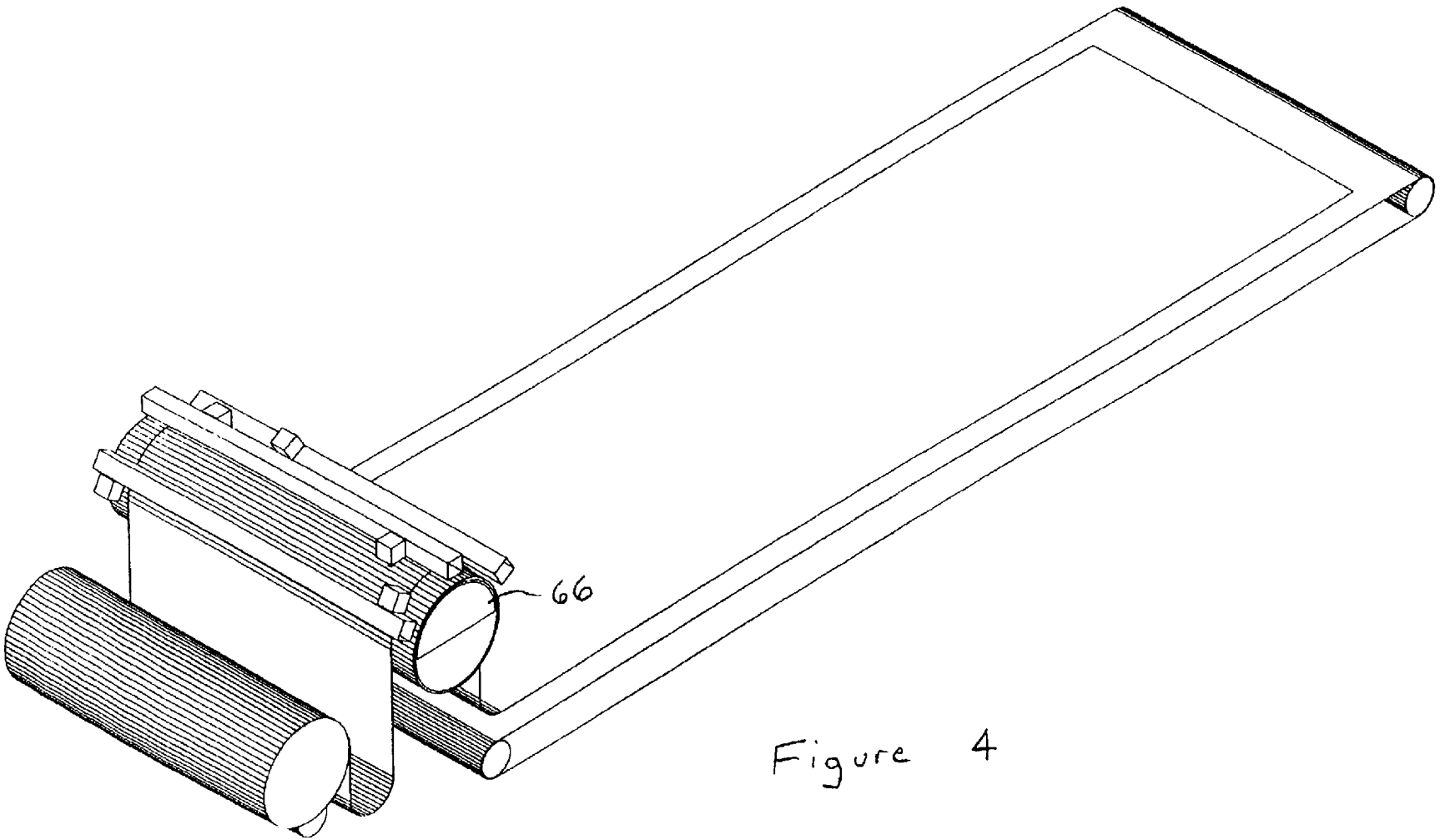
FIG. 4 is a partial perspective view of the rotating drum taken from a point above and to the left of the rotating cylindrical cutting surface.
Figure 5:
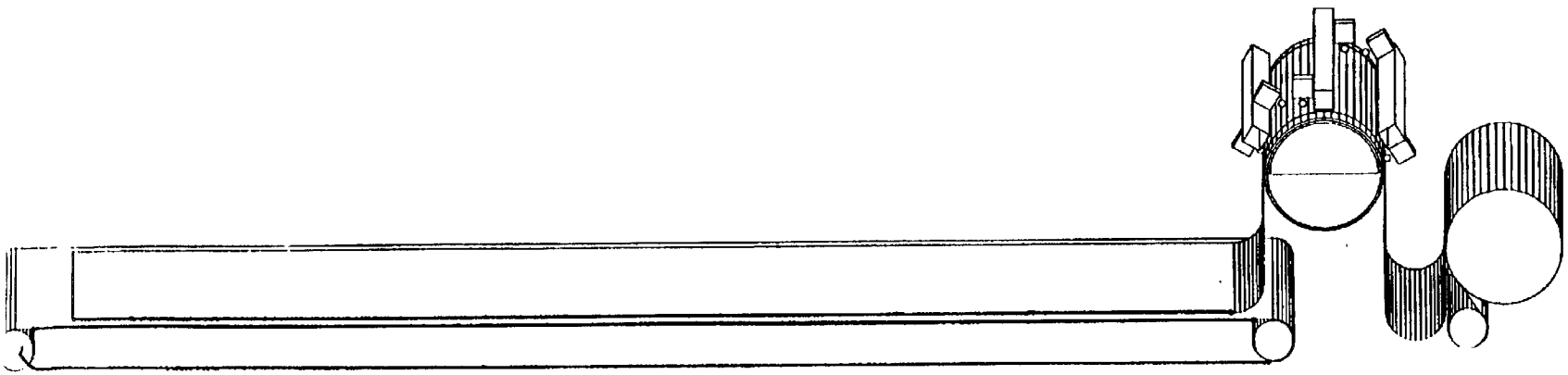
FIG. 5 is a partial perspective view of the rotating drum taken from the side.
Figure 6:
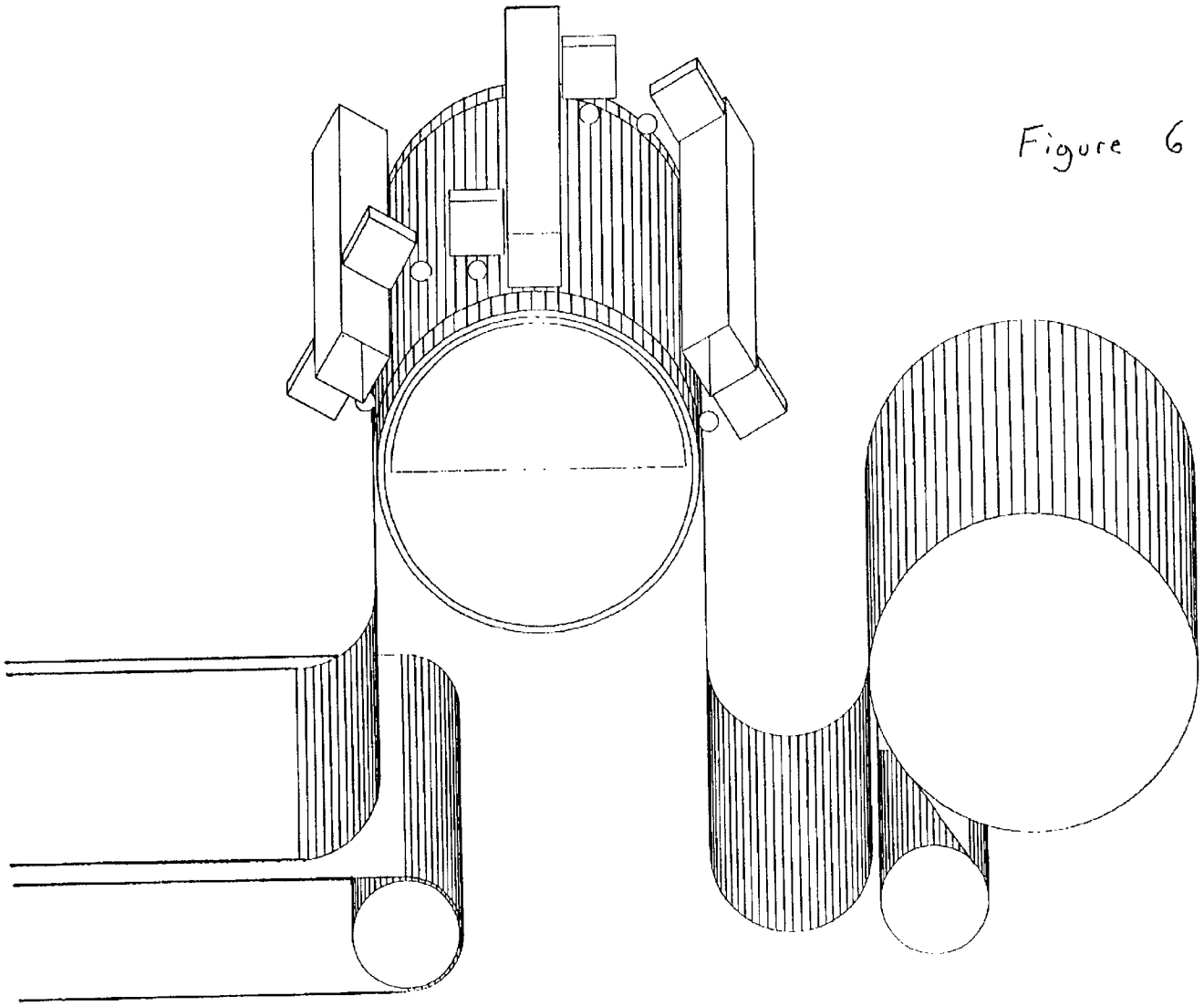
FIG. 6 is an expanded perspective view of the rotating drum.
Figure 7:
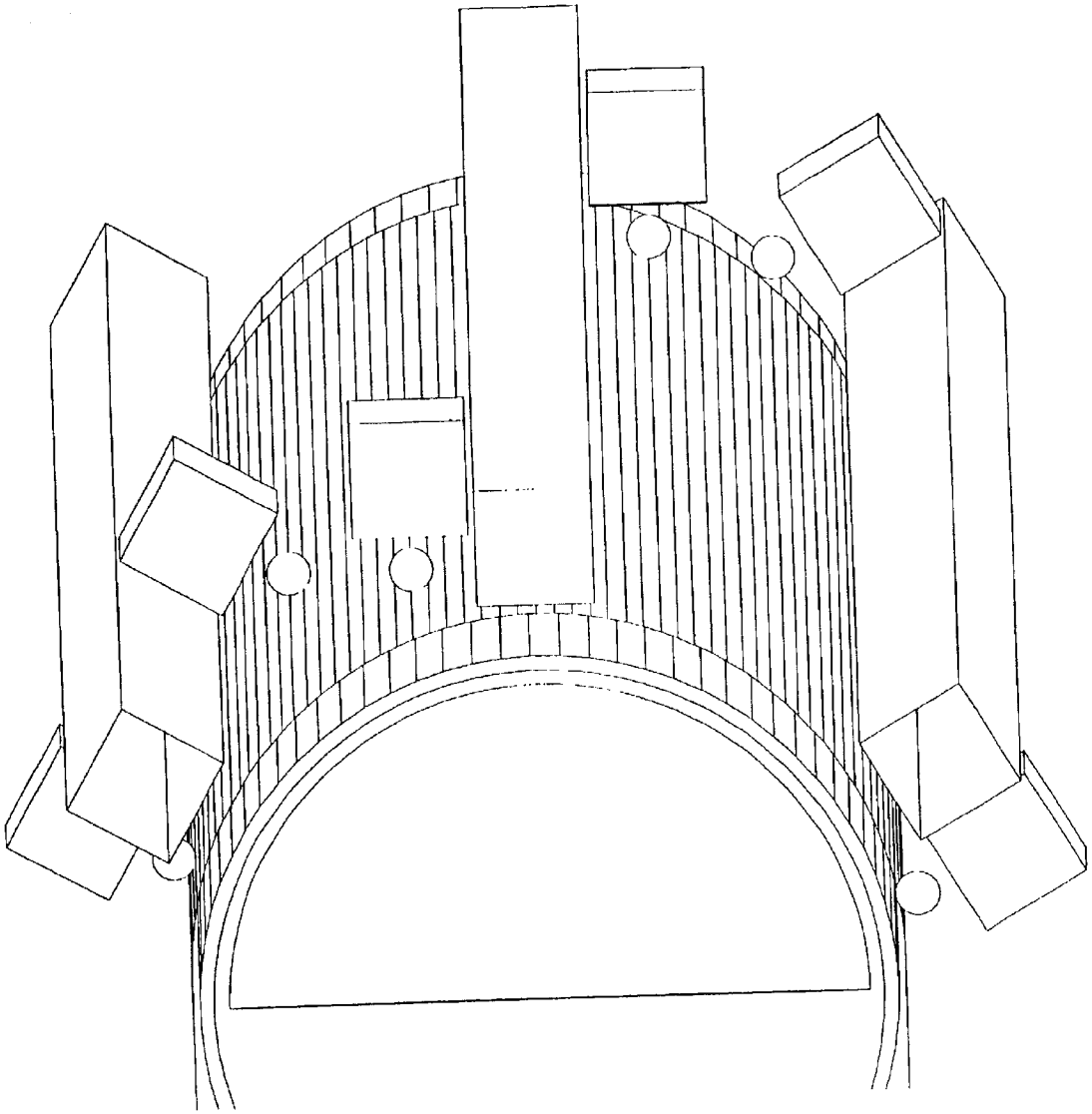
FIG. 7 is a further perspective view of the rotating drum.
Figure 9:
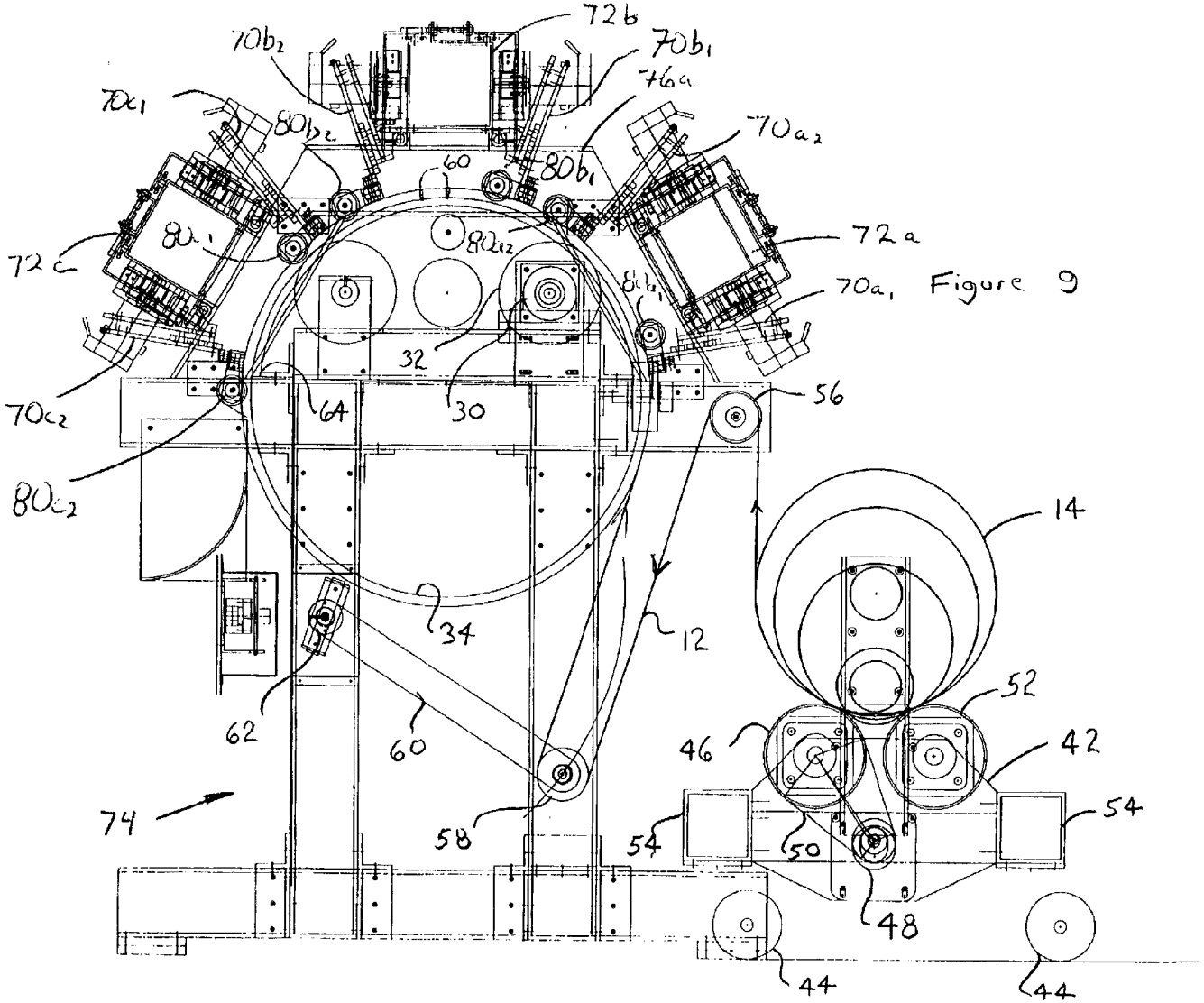
FIG. 9 is a side elevational view of the rotating drum.

FIGS. 3 and 4 illustrate generally the rotating cylindrical cutting surface 20 or drum 20. A more detailed view of the invention is shown in FIG. 9.

A roll of continuous material 14 is unwound as shown in FIGS. 3 and 4 in a manner so as to rotate over the drum or cylindrical surface 20.

The cutting surface 20 comprises a rigid drum or rotating cylindrical cutting surface 20. The axial length of the rotating drum 20 is slightly larger than the width of the roll of material 14 to be cut. The drum 20 is arranged so as to have its central axis 24 to be disposed substantially parallel to the axis of the roll 26.

The drum 20 rotates about its cental axis 24 in the direction shown by arrow A.

FIG. 9 best illustrates that the drum 20 is rotated by means of a motor 30 which drives a drive wheel 32 disposed internally of the drum 20. In particular, the drum 20 is hollow and has disposed within the bore 34 of the cylindrical cutting surface 20 the drive wheels 32. The drive rolls 32 frictionally engage the inner surface of the cylinder 20. Accordingly, the drum 20 rotates about its central axis 24 in one direction so as to continually advance the web of material 12 from the roll of material 14 up over the top of the drum arc. The material 14 starts to leave or peel away from the drum surface 22. In other words, the material 12 will commence to leave the surface of the drum 22 along a tangent point from the vertical top side of the drum surface 22.

Figure 8:
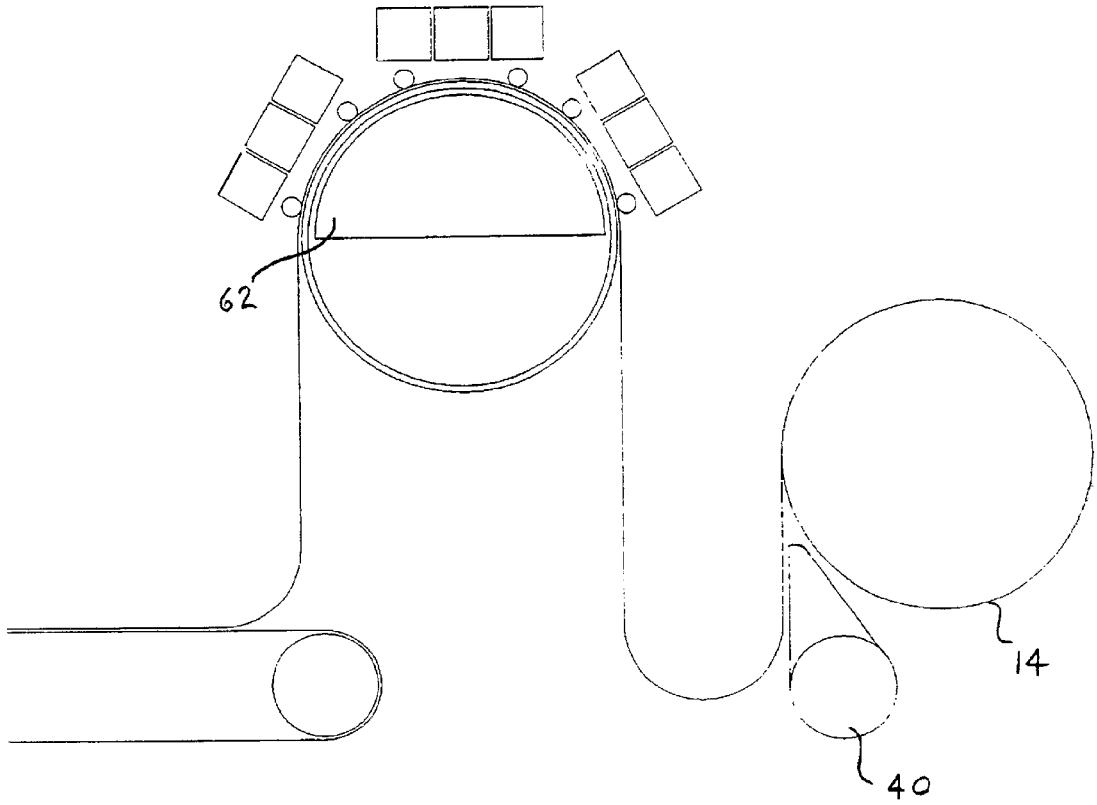
FIG. 8 is a representative view of the side of the rotating drum.

The roll of vinyl material 14 tends to cling to itself as it is unrolled from the roll 14 due to static cling and other factors. Accordingly, in order to assist the unrolling of the vinyl web 12 from the roll 14 a blast of flow or air may be directed by means of air flow assist blower 40 as best shown in FIG. 8.

Optionally corona discharge or charge contact rollers could be added to enhance or relieve static electrial phenomena or build up during operation.

The roll 14 of material comes in a variety of lengths but generally speaking one example of a typical roll of vinyl used for pool covers comes in lengths of 72 inches. Such rolls may weight up to 1000 lbs. depending on diameter of same. Accordingly, the rolls 14 may be placed on a carriage 42 as shown in FIG. 9. The carriage 42 may also include wheels 44 so as to assist movement of the carriage 42 towards the drum 20. The carriage 42 also includes a drive roller or cylinder 46 driven by motor 48 by means of a pulley 50. Idler roller or cylinder 52 is also included. Housing frame 54 is also included as shown. The motor 48 is energized and controlled for example by a computerized system (not shown) so as to drive the cylinder 46 thereby causing the roll 14 to unroll so as to present a web of material 12 which is unwound as shown in FIG. 9. The web of material 12 is rolled over idler roller 56 and taken up by a dancer roller 58 as it rolls around the drum 20. The dancer roller 58 is attached to swingable arm 60 which pivots about connection 62 so as to take up any slack in the unrolled web of material 12. The speed of the motor 48 may be synchronized with the computer system so as to accommodate for the shrinking diameter 14 of the roll as it is unwound during the cutting process.

The web of material 12 is taken up over the top portion of the cylindrical rotating cutting surface 20 as shown in FIG. 9.

The drum 20 is hollow and includes a plurality of holes 60 which are drilled in through the thickness of the drum 20.

Representative drawings of the holes 60 are shown in FIG. 9. The holes 60 communicate with a vacuum which is created within the drum 20. In particular, it is only necessary to create a vacuum in the top half 62 of the rotating drum 20 as shown in FIG. 8 as the web 12 substantially contacts only the upper half of the rotating drum 20. An example of the vacuum that can be created within the drum 20 consists of two inches of water of vacuum. Appropriate seals 64 comprising for example of rubber strips seal the vacuum on the inside of bore 34. The sides of the drum 20 include side sealing panels 66 best seen in FIG. 4 so as to maintain the vacuum at the desired level.

As the web 12 rotates over the top portion of the drum 20 the web of the material 12 is drawn against the upper surface of rotating cylindrical cutting surface 20 by means of a generated vacuum communicating with bores 60. In other words, the internal vacuum draws the vinyl material against the rotating surface 20 by means of the bores 60 communicating with the internal vacuum. This assists in positing the vinyl web against the outside cylindrical surface of drum 20 with substantially few wrinkles, if any.

Figure 10:
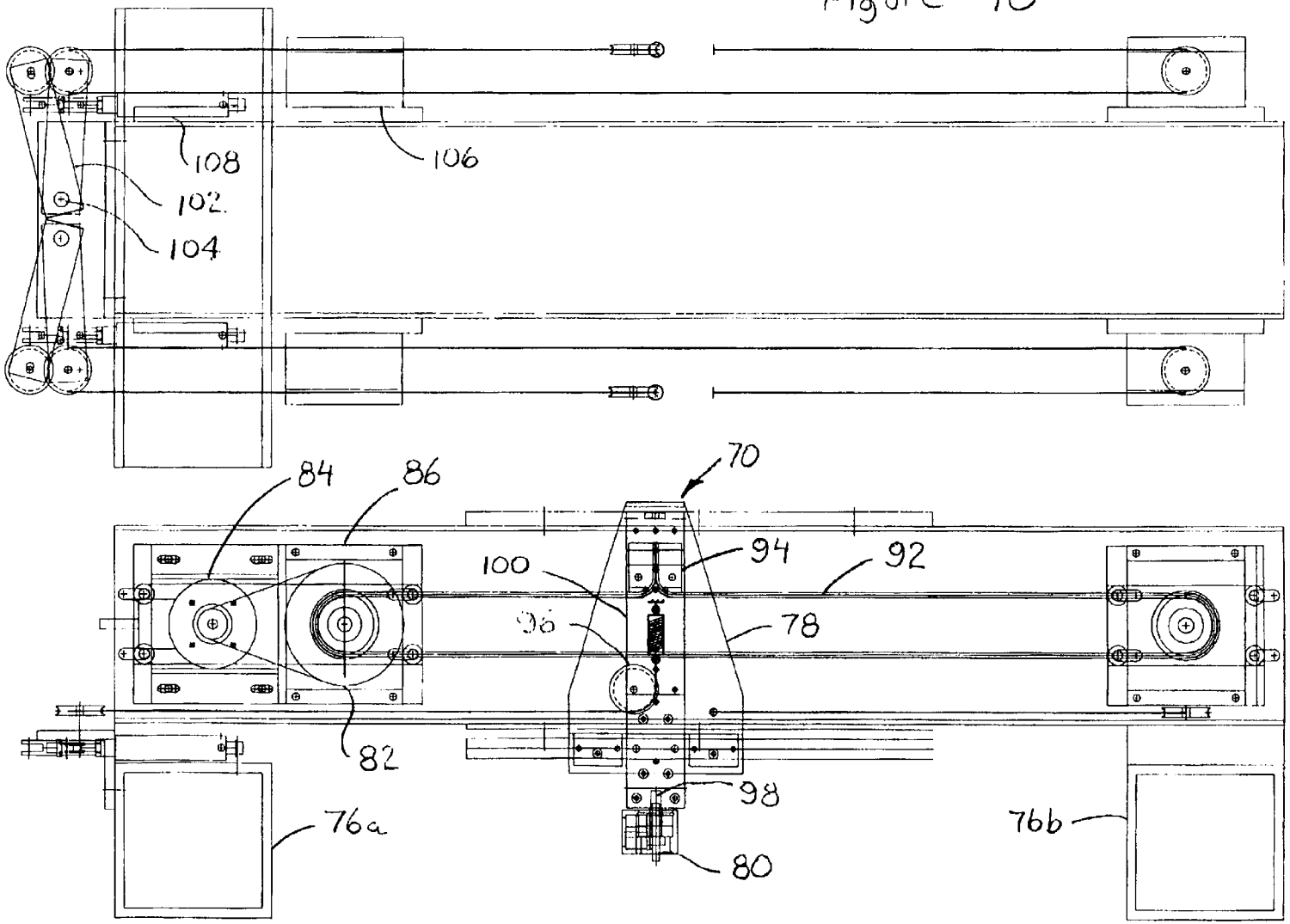
FIG. 10 is a top view of the cutting tools.

The cutting means 70 are supported on a plurality of rails 72 which are disposed generally parallel to the axis of rotation 24. In particular, a plurality of rails 72 may be utilized. In the embodiment shown in the figures three rails 72*a*, 72*b* and 72*c* are illustrated. However, any number of rails can be utilized. The rails 72*a*, 72*b* and 72*c* generally span the width of the rotating drum 20 and beyond. In particular the frame 74 of the apparatus includes two end supports 76*a* and 76*b* which extend beyond the ends of the rotating cylinder 20 as best illustrated in FIG. 10. The frame 74 including the end supports 76*a* and 76*b* can be made from a variety of materials and in the preferred embodiment comprise of aluminium for strength and light weight. Moreover, the rotating cylindrical cutting surface or drum 20 can also be comprised of a variety of materials while in the preferred embodiment is made from plastic materials such as polypropylene or the like.

The frame structure 74 and particulary the end supports 76*a* and 76*b* can be made from aluminium barstock which is hollow which further adds to its rigidity and light weight as shown in FIG. 10.

The plurality of rails 72*a*, 72*b* and 72*c* are connected to the end supports 76*a* and 76*b*. The side profile of the end supports 76*a* and 76*b* can have any shape but are shown in FIG. 9 has being three side or the top half of an hexagonal shape.

The end supports 76*a* and 76*b* are fixed to the frame 74 as well as the plurality of rails 76. Each of the rails includes cutting means 70 which comprise of a cutting head or carriage 78 having a cutting wheel 80. In particular each of the rails shown in FIG. 9 include a pair of cutting means 70 as shown, one on each side of the rail. In particular 72*a* includes cutting means 70*a*-1 and 70*a*-2 each presenting a cutting wheel 80*a*-1 and 80*a*-2. Moreover, the second rail 72*b* presents a pair of cutting means 70*b*-1 and 70*b*-2 presenting a cutting wheel 80*b*-1 and 80*b*-2 respectively. Furthermore, the third rail 72*c* presents a first cutting means 70*c*-1 and 70*c*-2 presenting a cutting wheel 80*c*-1 and 80*c*-2 respectively. Although the invention has been described herein in relation to three rails 72 having three pair of cutting means 70, any number of rails and cutting means could be utilized in the teachings of this invention.

Each of the cutting wheels 80 have a sharp cutting edge which can cut the vinyl material 12 as it is rotated about the drum 20.

In particular the cutting means 70 is moveable or displaceable relative the rail 72 as well as the drum 20 in the manner which shall now be described. The carriage 78 of the cutting means 70 is adapted to slide along the length of the rail 72. The rail 72 includes a pulley wheel 82 which is driven by a motor 84. The pulley wheel 82 and the motor 84 is retained by the appropriate motor housing 86 located at one side of the rails 72. The other side of the rail 72 includes an idler pulley 88 adapted for free rotation relative idler pulley support 90 which is attached to the other end of the rail 72. A pulley belt 92 is looped around for frictional engagement with the drive pulley 82 so as to form an endless belt about the drive pulley 82 and idler pulley 88. The ends of the pulleys are clamped together by pulley clamping means 94. An intermediate idler pulley wheel 96 is attached to the carriage 70 so as to prevent sagging of the endless loop of the pulley 92.

Accordingly motor 84 can be energized so as to activate the pulley wheel 82 thereby causing carriage 78 to move from left to right as shown in FIG. 10 thereby moving the cutting means 70 and in particular the cutting wheel 80 across the surface of the drum 20. The motor 84 can be controlled by any number of means including computerized means.

The cutting wheel 80 has a peripheral cutting edge which rolls on the cutting support surface of drum 20 along a cutting path. The cutting wheel 80 pivotally swings about an axis 98 depending on the motion of the carriage 78. The cutting means 70 and in particular the cutting head 100 is adapted to be pulled away or driven into the rotating cylindrical cutting surface 20 in the manner to be described herein. In particular, the cutting means 70 also includes means to selectively activate and deactivate engagement of the cutting wheel 80 relative the web 12 of material. In particular, FIG. 10 shows the use of tension engagement arm 102 which swings about axis 104. A cable 106 is attached to cable clamping means 108 and connected to the displaceable cutting head 100. The other end of the cable 106 is looped around cable pulley means 108. Accordingly in order to activate the cutting heads 80 so as to cut the material 12, a signal is dispatched so as to energize the movement of the arm 102 as shown in FIG. 10 so as to increase the tension in the cable 106 thereby causing the cutting head 100 to be driven into cutting engagement with the web of material 12. In order to deactivate the cutting engagement of the cutting wheel 80 relative the material 12, the cutting arm 102 is de-energized causing the cable 106 to relax and pulling the cutting wheel 80 away from cutting engagement from the web of material 12. The cutting wheel 80 may either freely rotate along the web 12 or pulled slightly away therefrom.

Each of the cutting means 70 on either side of the rails 72 include the means for displacing the cutting means 70 relative the rail 72 as well as the material 12. Accordingly each of the six cutting wheels 80 shown in FIGS. 9 and 10 can be controlled by automated means such as for example a computer whereby the cut patterns can be stored in the computer memory. Once the system described herein is energized, the web of material 12 can be pulled over the top circumferential surface of the drum 20 and the various cutting wheels activated and deactivated by the computer means so as to cut the vinyl material 12 to the desired pattern as shown for example in FIG. 2.

The preferred embodiment utilizes cutting wheels that are always in contact with the surface of the material to be cut or the surface of the supporting means. The wheels are castored allowing them to follow the direction of the cut path automatically. The downward (normal) force is dynamically adjusted such that with a light normal force the blade will not cut or mar the material surface, but will still follow the path of motion. When the normal force is increased significantly the blade cuts through the material, still maintaining its direction by the castoring force. This eliminates the need for a castoring motor, thus reducing the machine's hardware and software complexity.

Alternatively, one could utilize a computer controlled steering motor to orient the blade in a desired direction. Moreover, the cutting means may also include laser, ultra sonic, waterjet or other cutting or drawing means within the spirit of this invention. The drawing means by way of example could include pen devices to draw graphics on paper, cloth or the like.

The rotation of the drum may also be momentarily stopped by deactivating the motor 30 and the cutting means 70 activated so as to slide along the rails 72. This would represent a substantially lateral or traverse cut along the length of the web of material 12 as shown in FIG. 2. Longitudinal cuts as represented by for example panel G in FIG. 2 may be made by an appropriate roller wheel 80 being aligned as shown in FIG. 9. Curved cuts such as shown for example in panel B may be made whereby the computerized means energizes the motor 84 in an appropriate manner so as to present a curved cut B. In other words all of the cutting wheels 80 are activated at the same time but only as desired to make the appropriate cuts. Therefore a single, a pair, three, four, five or all six of the cutting wheels may be activated or deactivated as required. For greater particularity, a single or plurality of cutting means can be used within the scope of this invention.

Prior art devices used heretofore can be operated to cut a web of material 12 at a rate of eight inches per second. It has been determined that by utilizing the invention described herein cutting speed of 60 inches per second may be utilized. Accordingly the apparatus can be used to efficiently and quickly improve productivity as well as utilizing a smaller space within a plant. Furthermore FIG. 3 shows that once the material is cut, the cut pattern may be deposited on a conveyor system 120. The scrap material 16 may also be removed.

Moreover when the material 12 is wrapped unto the drum 20 the material 12's principal curvature or pulling is in the advanced direction or direction of rotation. This causes a substantially large decrease in the curvature in the transverse direction. Accordingly any material waviness or unflat areas are substantially removed and the material lies substantially flat against the drum 20. Cutting therefore becomes more accurate and substantially eliminates the application of residual stresses which can cause the material to move or snap back as the cutting wheel passes.

A flat cutting surface as utilized in the prior art must force the material to lay flat. This distorts or shears the material 12. Such shearing applies residual stresses to the material in the flat plane which can cause movements in the material as the cutter passes.

Moreover the material 12 as shown in the drawings has a tangible entry and exit to and from the rotation cylindrical cutting surface which also assists in flattening the material when it is applied to the cutting surface. Accordingly the rotating drum enhances automatic material alignment since the entry to the rotating surface 22 is tangential and vertical. Therefore the material 12 tends to be in its final cutting geometry as it is applied to the drum 20. Furthermore as the material 12 is applied with curvature it tends not to shift as the vacuum comes on during rotation nor when the material 12 is exiting from the rotating drum 20. Moreover, the cutting surface is not sliding over a fixed surface but rather on a rotating drum thereby permitting the cutting surface to support itself. This permits the vacuum to be running all of the time in a fixed location eliminating the need for switching or valving the vacuum pressure. Furthermore the surface event friction is minimized by utilizing the drum described herein. Moreover the vacuum is applied smoothly to the material so that the material 12 maintains its position on the cutting surface.

Moreover by utilizing drive motors 84 attached to the ends of the rails 72 rather than attaching same to carriage 78 the mass of the cutting means 70 is minimized which allows for increased acceleration of the carriage 78 for maximum speed. In other words the drive mechanisms 84 do not add to the accelerated mass which increases its inertia. However the invention described herein can include any number of drive means utilizing a belt or rigid shaft.

Moreover the multiple independent cutting heads 100 permit the system to operate without wasting time in back tracking and dry haul motions. Dry haul motions generally relate to cutter positioning motions while not cutting. Such dry haul motion is substantially eliminated by virtue of the fact that while some of the heads are engaged in cutting the remaining heads are moving into position to begin their pass.

Moreover the device described herein can for example have substantially instantaneous material speeds of 60 inches per second with sustained performance of 30 inches per second which can yield 16 by 32 size liner cuts in substantially under a minute. Such specifications have been added by way of example only and not to limit the scope of the invention herein. Such speeds are achieved without operator intervention in the cutting process.

Moreover substantially zero back tracking, zero dry haul and rigid cylindrical cutting surfaces give the system as described herein considerable speed advantage over traditional cutters while relying on simpler mechanical components.

Moreover by utilizing a computer system cutting files can be stored and queued by the cutter controlled software and executed on a continuous basis until a bookmark is encountered within a file or between files pausing the cutter while the operator wheels a new roll of material 14 into place and pins it to the cutter frame 74. Should a material roll 14 run out during operation the cutter will pause and wait for reload. Moreover the operator may pause the cutting operation at any time.

The cut pieces are automatically deposited unto an off-load lamp 120 which can consist of a perforated deck gently sloping away from the cutter to float the cut pieces on a bed of low pressure air. At this stage an operator can fold pieces in preparation for welding.

The system as described herein in relation to an air assist vinyl unwinding system 40. Alternatively a row of small rollers could be placed at the same location where the air exits, peeling the vinyl 12 from the roll without adding tension.

Various embodiments of the invention have now been described in detail. Since changes in and/or additions to the above-described best mode may be made without departing from the nature, spirit or scope of the invention, the invention is not to be limited to said details.

Although the preferred embodiment as well as the operation and use have been specifically described in relation to the drawings, it should be understood that variations in the preferred embodiment could be achieved by a person skilled in the trade without departing from the spirit of the invention as claimed herein.

What is claimed is:

1. A method of cutting pattern pieces from a continuous web of material comprising the following steps:

providing at least two cutting means and a rotating cylindrical cutting surface;

driving a cylinder that defines the cylindrical cutting surface internally of the cylindrical cutting surface;

advancing the web of material over the cylindrical cutting surface;

moving the cutting means across the cylindrical cutting surface; and cutting the web of material while rotating the cylindrical cutting surface in only one direction.

2. A method of cutting pattern pieces from a continuous web of material comprising the following steps:

providing at least two cutting means and a rotating cylindrical cutting surface;

providing a hollow cylinder having an outside surface that defines the cylindrical cutting surface, the hollow cylinder having holes therein communicating with the cylindrical cutting surface;

providing a suction air supply in association with the hollow cylinder;

creating a vacuum internally of the rotating cylindrical cutting surface that communicates with the surface;

advancing the web of material over the cylindrical cutting surface;

moving the cutting means across the cylindrical cutting surface; and cutting the web of material while rotating the cylindrical cutting surface in only one direction.

* * * * *